United States Patent [19]

Savage

[11] 4,209,262

[45] Jun. 24, 1980

[54] PRINT WHEEL LOADING APPARATUS

[75] Inventor: James G. Savage, Newark, Calif.

[73] Assignee: Xerox Corporation, Stamford, Conn.

[21] Appl. No.: 960,988

[22] Filed: Nov. 15, 1978

[51] Int. Cl.[2] ..... B41J 1/30

[52] U.S. Cl. ..... 400/144.2; 101/93.17; 101/93.19

[58] Field of Search ..... 400/144.2, 156, 157, 400/175, 320, 144, 144.1, 144.3, 144.4; 101/93.15, 93.16, 93.17, 93.18, 93.19, 111; 206/444

[56] References Cited

U.S. PATENT DOCUMENTS

| | | | |
|---|---|---|---|
| 3,772,988 | 11/1973 | Bowers, Jr. et al. | 101/111 |
| 3,774,531 | 11/1973 | Hansen et al. | 101/111 X |
| 3,892,303 | 7/1975 | Willcox | 101/93.18 X |
| 3,915,086 | 10/1975 | McManaman | 101/93.19 |
| 3,991,873 | 11/1976 | Paulson | 101/93.19 X |
| 4,026,403 | 5/1977 | Iwose et al. | 400/144.2 X |
| 4,037,532 | 7/1977 | Plaza et al. | 400/157.2 |
| 4,049,109 | 9/1977 | Plaza et al. | 400/144.2 X |
| 4,124,312 | 11/1978 | Johnson | 400/144.2 |
| 4,127,335 | 11/1978 | Bogert et al. | 400/144.2 |
| 4,161,373 | 7/1979 | Chvatlinsky | 400/144.2 X |

*Primary Examiner*—E. H. Eickholt
*Attorney, Agent, or Firm*—Barry Paul Smith

[57] ABSTRACT

For use in an impact printer having a movable carriage, a motor supported by the carriage and including a rotatable shaft, and a drive coupling member affixed to an end of the shaft, apparatus is provided for loading a print wheel contained in a cartridge onto the drive coupling member in order for the print wheel to be rotated by the motor. The apparatus includes a support member mounted to the carriage for movement therewith. A guide member is mounted to the support member for movement generally parallel to the axis of rotation of the shaft between first and second positions. The guide member is adapted when in its first position to engage and guide the movement of a print wheel cartridge along the guide member in a direction generally transverse to the axis of rotation of the shaft. The apparatus also includes means coupled to the support member and active upon movement of a print wheel cartridge along the guide member for automatically moving the guide member from its first position to its second position to thereby load a print wheel contained in the cartridge onto the drive coupling member.

3 Claims, 8 Drawing Figures

PRINT WHEEL LOADING APPARATUS

BACKGROUND OF THE INVENTION

This invention relates to impact printers of the type employing rotatable print wheels and, more particularly, to apparatus for loading a print wheel contained in a cartridge onto the shaft of the print wheel drive motor.

U.S. application No. 767,249 now U.S. Pat. No. 4,124,312 filed on Feb. 10, 1977 in the name of Robert A. Johnson and assigned to the assignee of the present invention, and U.S. application No. 767,250 now U.S. Pat. No. 4,127,335 filed on Feb. 10, 1977 in the names of David L. Bogert and Jammie D. New and also assigned to the assignee of the present invention, disclose a number of devices for loading a print wheel contained in a cartridge onto the shaft of the print wheel drive motor. As pointed out in such applications, the use of print wheel cartridges and associated loading mechanisms enables easy print wheel removal and exchange without having to first pivot the entire print wheel-drive motor assembly to expose the front face of the wheel, as is currently done in commercial daisy-wheel printers.

The print wheel loading apparatus disclosed in the aforementioned U.S. Pat. No. 4,127,335 requires relative motion between the print wheel cartridge and the guide member therefor in two directions, i.e., the cartridge is first moved along the guide member in a direction generally transverse to the axis of the motor shaft, and is then pivoted relative to the guide member in a direction towards such shaft to thereby load the print wheel onto a drive coupling member affixed to an end of the shaft. Having two relative movements required between the print wheel cartridge and its guide member increases the possibility of misregistration of the print wheel hub and the drive coupling member on the motor shaft.

It would be desirable, therefore, to provide a print wheel loading apparatus of the general type disclosed in the aforementioned U.S. Pat. No. 4,127,335, but wherein the relative motion required between the print wheel cartridge and the guide member to load the print wheel onto the drive coupling member is reduced to motion in only a single direction.

SUMMARY OF THE INVENTION

In accordance with the invention, a print wheel loading apparatus is provided for use in an impact printer of the type comprising a movable carriage, a motor supported by the carriage and including a rotatable shaft, and a drive coupling member affixed to an end of the shaft. The apparatus is capable of loading a print wheel contained in a cartridge onto the drive coupling member in order for the print wheel to be rotated by the motor. The apparatus comprises a support member mounted to said carriage for movement therewith; a guide member mounted to said support member for movement generally parallel to the axis of rotation of said shaft between first and second positions, said guide member being adapted when in its first position to engage and guide the movement of a print wheel cartridge along said guide member in a direction generally transverse to the axis of rotation of said shaft; and means coupled to said support member and active upon movement of a print wheel cartridge along said guide member for automatically moving said guide member from its first position to its second position to thereby load a print wheel contained in said cartridge onto said drive coupling member.

It is thus apparent that the print wheel cartridge moves relative to the guide member in only one direction, i.e., transverse to the axis of rotation of the shaft. The guide member itself then moves the print wheel cartridge in the direction of the shaft. There is no additional relative movement between the cartridge and the guide member.

These and other aspects and advantages of the present invention will be described below with reference to the accompanying drawings.

DESCRIPTION OF THE PREFERRED EMBODIMENT

Figure 1:
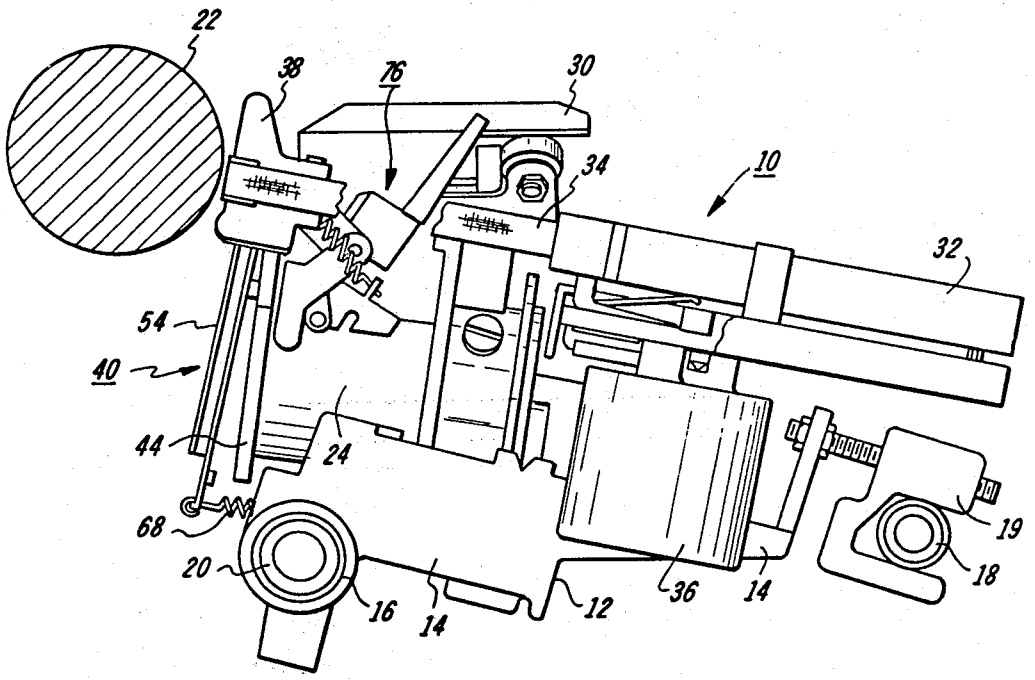
FIG. 1 is a side view, partially broken and in section, of a print carriage including the print wheel loading apparatus of the invention, wherein such apparatus is shown in an unloaded position.

Referring to FIG. 1, a carriage assembly 10 is shown for use in a serial printer of the general type disclosed in U.S. Pat. No. 4,049,109. Thus, the carriage assembly 10 includes a main frame 12 having opposing side walls 14 (only one visible). The main frame 12 has a pair of aligned openings 16 formed in the respective side walls 14 adjacent a front end of the carriage assembly 10. The openings 16 are adapted to receive in locked relation a linear bearing assembly 20 which is desirably of the type disclosed in U.S. Pat. No. 3,985,404. A similar bearing assembly 18 is attached by a bracket assembly 19 to the side walls 14 thereby enabling the carriage assembly to be transported along a pair of parallel rails (not shown) engaged through the pair of linear bearing assemblies 20 and 18, and thus moved past a platen 22 included in the printer.

The carriage assembly 10 is adapted to transport and includes a print wheel drive motor 24 for controlling the direction and speed of rotation of a print wheel 26 (FIG. 4) engaged with the motor drive shaft 28 (FIG. 3) in a manner to be described below. Also supported by the carriage assembly 10 are a hammer assembly 30 for impacting an aligned character element on the print wheel 26 against the adjacent platen 22, a ribbon cartridge 32 for supplying inked ribbon 34 between the hammer assembly 30 and the platen 22, and a ribbon cartridge drive motor 36 for transporting ribbon 34 in front of the hammer assembly 30 along a pair of guides 38 (only one shown) during operation of the printer.

The specific nature of the hammer assembly 30 and ribbon cartridge 32 form no part of the present invention and this will not be described in detail herein. However, details of a preferred hammer assembly are disclosed in U.S. Pat. No. 4,037,532, and details of one type of ribbon cartridge that may be mounted to the carriage assembly 10 is disclosed in copending U.S. application No. 960,989 filed concurrently herewith in the names of James E. Cushman and Mario G. Plaza for RIBBON LIFT APPARATUS FOR RIBBON CARTRIDGE and assigned to the assignee of the present invention.

Figure 2:
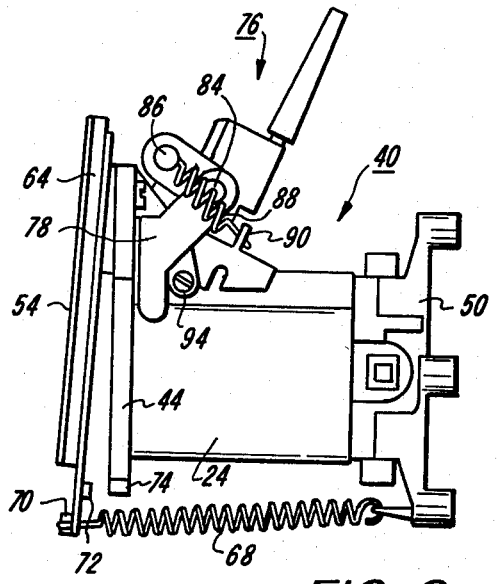
FIG. 2 is a side view of the print wheel loading apparatus of the invention shown in an unloaded position.
Figure 3:
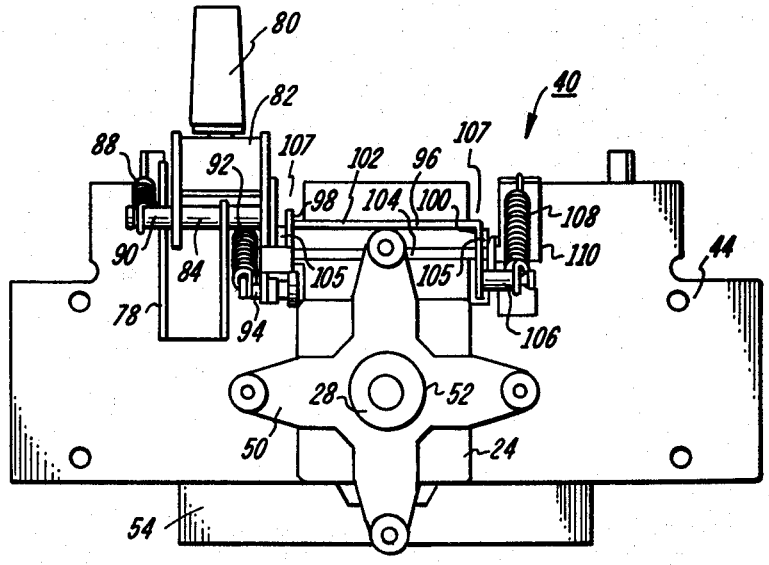
FIG. 3 is a rear view of the print wheel loading apparatus of the invention shown in a loaded position.
Figure 4:
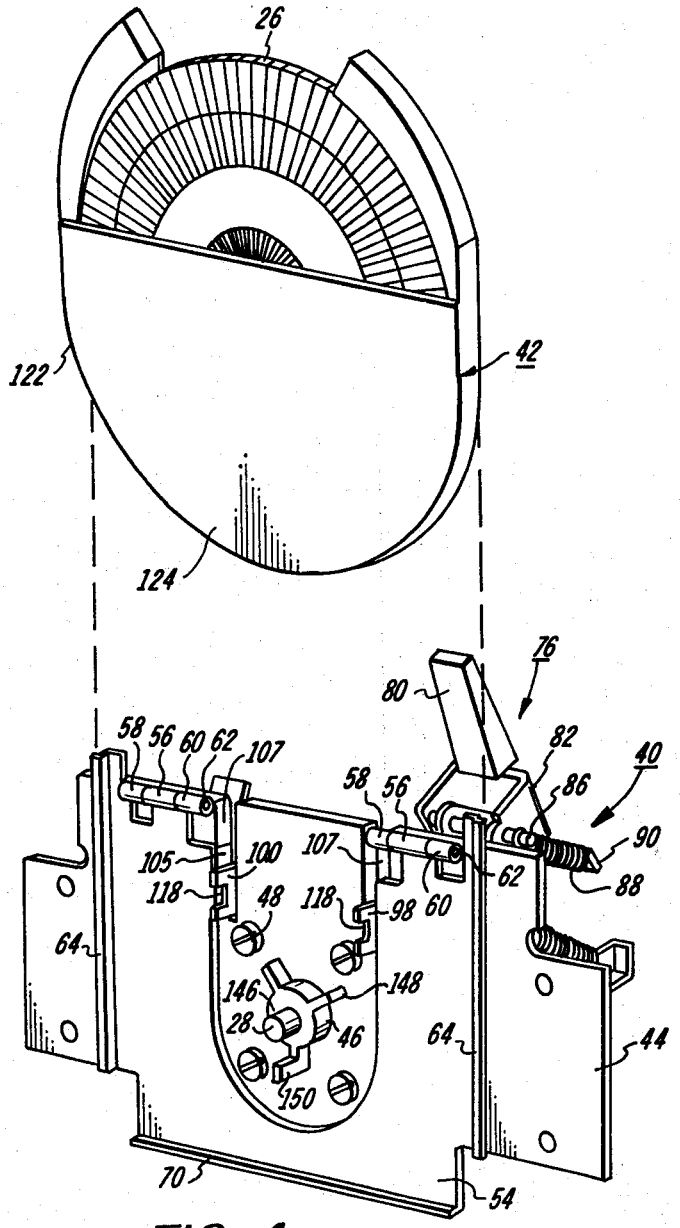
FIG. 4 is a front perspective view of the print wheel loading apparatus of the invention shown in a loaded position, as well as of a print wheel cartridge that would normally be engaged with the loading apparatus in its loaded position.

Referring now to FIGS. 1–4, the carriage assembly 10 includes a print wheel loading apparatus 40 for loading a print wheel 26 contained in a print wheel cartridge 42 onto the drive shaft 28 of the print wheel drive motor 24. The loading apparatus 40 includes a support member in the form of a plate 44 that is attached by suitable means (not shown) to the main frame 12 of the carriage assembly 10. As best shown in FIG. 4, the plate 44 has an opening 46 therein through which the drive shaft 28 of the motor 24 is adapted to be disposed. To this end, the print wheel motor 24 is mounted by suitable means, such as four mounting screws 48, to the rear side of the plate 44.

Attached to the rear of the print wheel motor 24 is a mounting bracket 50 to which a conventional inductive transducer assembly (not shown) may be mounted. To this end, an opening 52 is formed through the mounting bracket 50 for accomodating the shaft 28 of motor 24. As is well known, inductive transducer assemblies, such as the one disclosed in U.S. Pat. No. 4,059,789 by way of example, generate a position signal that can be sensed to keep track of the rotational position of the shaft 28 and thus that of a print wheel 26 loaded thereon.

Hinged to the front of the support plate 44 is a guide member 54 for guiding the movement of the print wheel cartridge 42 in a manner to be described below. Referring specifically to FIG. 4, the guide member 54 has a pair of hollow cylindrical extension portions 56 that are each adapted to be juxtaposed between a pair of similarly configured hinge portions 58 and 60 mounted to the plate 44 to thereby form a pair of hinge assemblies. A pair of pins 62 project through and form part of the hinge assemblies so that the guide member 54 is pivotable relative to the support plate 44 about the hinge pins 62. The guide member 54 has a pair of edge sleeves 64 for accomodatng complementary edge guide members 66 on the rear side of the print wheel cartridge 42 (see FIG. 5).

As best shown in FIG. 2, a spring 68 is fastened in tension between a lower lip portion 70 of the guide member 54 and the mounting bracket 50. The purpose of the spring 68 is to bias the guide member 54 is the direction of the support plate 44. As will be seen below, the guide member 54 is pivotable about the hinge assemblies (56–62) for movement generally parallel to the axis of shaft 28 (actually the path of movement is somewhat arcuate) between a first, unloaded position shown in FIG. 2, and a second, loaded position shown in FIG. 6. A stop 72 formed at the lower end of the guide member 54 engages a projection 74 extending downwardly from the support plate 44 to define the rearward limit of travel of the guide member 54 and also to define its second, loaded position.

A pivot control assembly 76 normally maintains the guide member 54 in its first, loaded position until a print wheel cartridge 42 is received by the guide member 44 and guided in a downward direction due to the cooperation of the sleeves 64 on the guide member 54 and edge guide members 66 on the cartridge 42. When the print wheel cartridge 42 reaches a predetermined position during downward movement along the guide member 44, the pivot control assembly 76 is actuated in a manner to be described below to release the guide member 54 from its first position and allow it to move toward the plate 44 under the biasing action of the spring 68. The guide member 54 will then come to rest at its second, loaded position when the stop 72 engages the projection 74.

Reference is now had to FIGS. 2–2, particularly FIG. 3, where the pivot control assembly 76 will be described in more detail. As shown, the assembly 76 includes a bracket 78 mounted to the rear side of the support plate 44. A lever arm comprised of a lever 80 affixed to a support 82 is pivotally mounted to the bracket 78. More specifically, the support 82 is pivotable about a pivot pin 84 that is disposed through aligned openings in the bracket 78 and support 82. The bracket 78 has another pin 86 (FIG. 4) mounted through aligned openings in the bracket side walls. A spring 88 is mounted at one end to the pin 86 and at its other end to a projecting portion 90 of the support 82. In the print wheel loaded position shown in FIGS. 3 and 4, the spring 88 is offset upwardly of the pin 84, whereas in the unloaded position shown in FIGS. 1 and 2, the spring 88 is offset downwardly of the pin 84. The spring 88 is thus an "over-center" spring that acts to bias the lever arm 80 in a forward direction when pivoted forwardly (FIGS. 3 and 4) and to also bias the lever arm 80 in a rearward direction when pivoted rearwardly (FIGS. 1 and 2).

Figure 7:
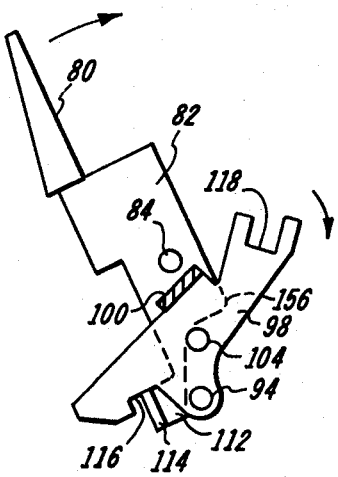
FIG. 7 is a side view of a portion of a pivot control assembly of the loading apparatus, shown in an unloaded position, such side view being opposite the side view of FIG. 2.
Figure 8:
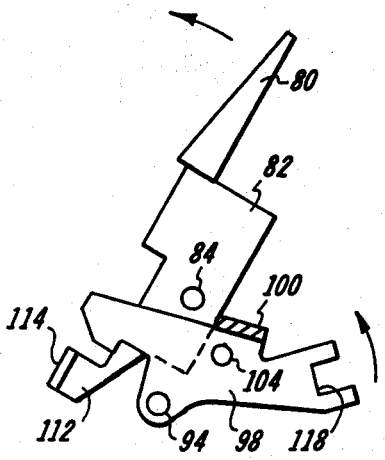
FIG. 8 is a similar view as FIG. 7, showing the portion of the pivot control assembly in a loaded position.

Another spring 92 is mounted at one end to the pin 86 at the end thereof opposite the end mounted to spring 88. The other end of the spring 92 is mounted to a pin 94 projecting from an engagement member 96. The engagement member 96 is desirably U-shaped having a pair of engagement finger portions 98 and 100 at either end of a cross-bar 102. This relationship is best shown in FIGS. 3, 7 and 8 viewed conjunctively. The engagement member 96 as a whole is pivotably mounted about a pivot rod 104 mounted at either end to a respective pair of flange portions 105 forming part of the guide member 54 and extending rearwardly through slots 107 in the support plate 104. A pin 106 similar to pin 94 projects from the engagement finger portion 100. A spring 108 similar to spring 92 is connected at one end to the pin 106 and at its other end to a mounting bracket 110 affixed to the rear side of the support plate 44. Springs 92 and 108 serve to bias the pivot control apparatus in each of its first and second positions due to the preferred "over-center" mounting of the springs.

As best shown in FIGS. 3, 7 and 8, the support 82 for the pivot arm 80 has a depending flange portion 112 including a lip 114. When the pivot control assembly 74 is in its unloaded position (FIG. 7), the lip 114 is engaged with a notch 116 formed in the engagement finger portion 98, thereby providing a stop for rearward travel of the pivot arm 80 and thus forward travel of the guide member 54. The specific manner in which the rearward movement of pivot arm 80 causes a corresponding forward movement of the guide member 54 will be described below.

Figure 6:
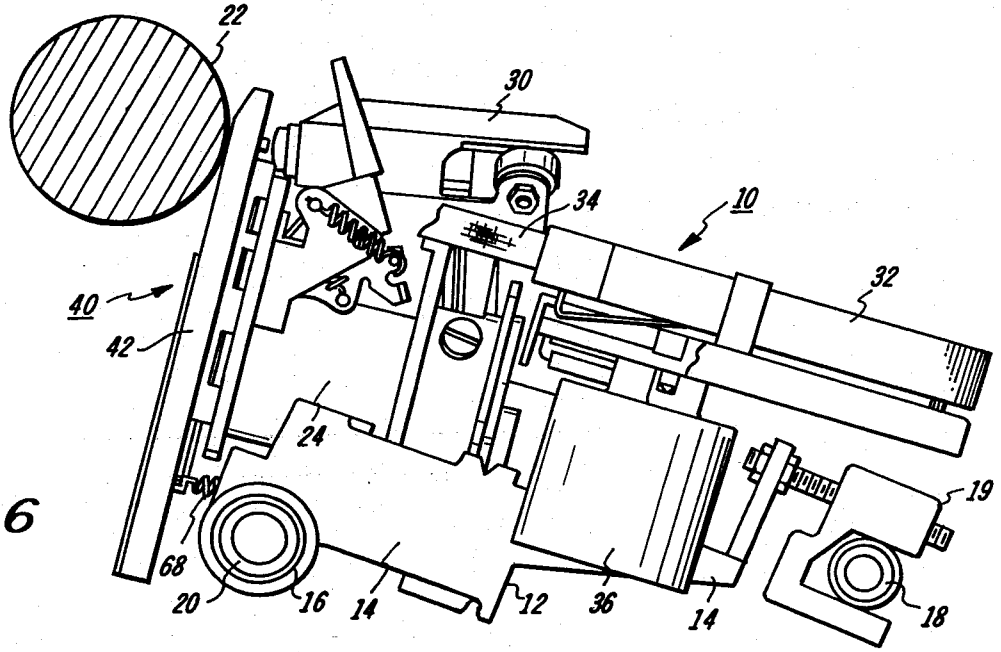
FIG. 6 is a similar view to FIG. 1, but showing the print wheel loading apparatus in a loaded position.

It should be noted at this point that each of the engagement finger portions 98 and 100 includes a notch 118 formed at its forward-most end, the notches 118 extending forwardly of the front surface of both the support plate 44 and guide member 54 (see FIG. 4). The purpose of this extension is to enable a pair of posts 120 projecting from the rear cover 126 of the print wheel cartridge housing 122 to engage the notches 118 during movement of the cartridge through the guide member 54 when same is in its first, unloaded position (see FIGS. 1, 2, 7). Further downward movement of the cartridge 42 will then cause the engagement finger portions 98 and 100 to pivot about the rod 104 thereby moving the pivot control assembly 74 and thus the guide member 54 into a loaded position (FIGS. 6 and 8). A pair of openings 121 formed in the rear cover 126 of the print wheel cartridge housing 122 provide clearance for the engagement finger portions 98 and 100.

Prior to describing the overall operation of the pivot control assembly 74, as well as the general operation of the print wheel loading apparatus 40, further details of a preferred print wheel cartridge 42 and print wheel 26 will be described with reference to FIGS. 4 and 5. As shown, the cartridge 42 includes a housing 122 adapted to accommodate a print wheel 26, which is desirably of the well-known "daisy-wheel" type, such as those marketed by Diablo Systems, Inc. of Hayward, Calif. and Xerox Corporation of Dallas, Tex. As will be seen below, however, the print wheel does contain certain modifications over those currently commercially available.

A front cover 124 of the housing 122 preferably covers only about two-thirds of the front face of the print wheel 26, as shown in FIG. 4. This allows a substantial portion of the character elements to be visible for inspection. Desirably, the front cover 124 is snapped into engagement with a rear cover 126 by means (not shown), thereby enabling the removal and replacement of print wheels 26 from the cartridge 42.

Figure 5:
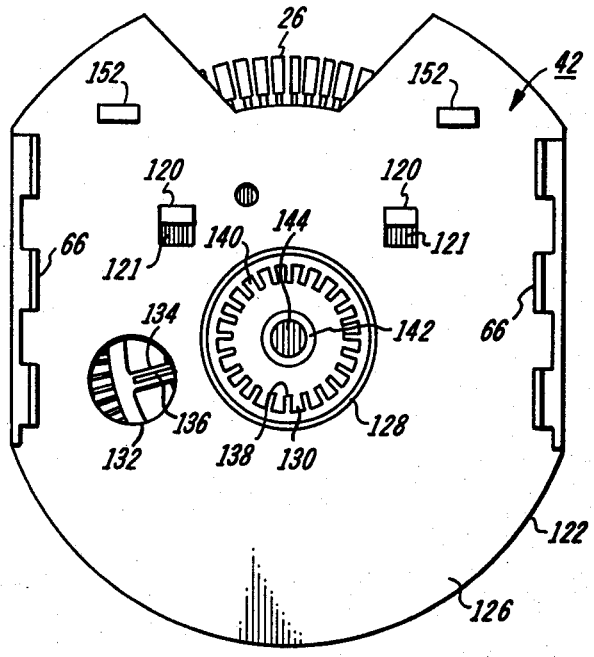
FIG. 5 is a rear view of the print wheel cartridge shown in FIG. 4.

Referring to FIG. 5, it will be noted that the rear cover 126 of the cartridge housing 122 includes a circular opening 128 for accommodating a uniquely configured hub portion 130 of the print wheel 26 in a manner enabling the free rotation of the wheel within the cartridge 42. A further opening 132 is provided to expose radial stiffening ribs 134 formed on the rear side of the print wheel 26 as the wheel is rotated. One of the ribs 134 preferably contains a magnetically or optically sensorable indicia 136. A suitable magnetic or optical sensor (not shown) mounted on the carriage assembly 10 in alignment with the opening 132 may be employed to detect the passage of the indicia 136. Such detection may be used to sense the "home" position of the print wheel, i.e., the print wheel 26 is brought to rest a predetermined number of character spaces following detection of the home indicia 136. Further ribs 134 may include similar indicia in a predetermined pattern (some ribs have indicia and others do not), thereby defining a code to indicate the type of character font used and/or a desired hammer energy base level for inpacting the character elements by the hammer assembly 30.

As shown in FIG. 5, the hub portion 130 of the print wheel 26 is defined by a ring having a plurality of uniformly spaced teeth 138, thereby defining a plurality of uniformly spaced slots 140 between the teeth 138. A further ring 142 defines an opening 144 therein for accommodating the shaft 28 of the print wheel drive motor 24. As best shown in FIG. 4, mounted to an end of the drive shaft 28 is a drive coupling member 146. The member 146 has a plurality of arms 148, e.g., three, extending radially outward and spaced uniformly apart, e.g., 120° apart. Projecting forwardly of at least one arm 148 is a locating tab 150 for engaging one of the slots 140 in the hub portion 130 of the print wheel 26 when the wheel is loaded onto the drive coupling member 146 by the print wheel loading assembly 40. Each of the arms 148 may include a locating tab 150 thereon, if desired.

It is thus apparent that the print wheel 26 may be loaded onto the drive coupling member 146 in any rotational position. More specifically, the number of slots 140 enable the engagement of the wheel 26 with the drive coupling member 146 in virtually any rotational position of the wheel, whereas "home" sensing is assured since the home locating indicia 136 is formed on the wheel itself and may be detected by rotating the wheel following engagement with the drive coupling member 146.

Referring again to FIG. 5, the rear cover 126 of the cartridge housing 122 includes a pair of stops 152, it being recalled that posts 120 are used to engage the recesses 118 of the engagement finger portions 98 and 100 (FIGS. 4, 7 and 8). The stops 152 define a limit to the downward progression of the cartridge 42 through the guide member 54 by projecting rearwardly enough to engage the pair of hinge assemblies (56–62).

In operation, a desired print wheel 26 is selected for loading onto the drive coupling member 146 in order to be driven by the print wheel drive motor 24. The cartridge 42 containing such wheel 26 is then loaded onto the guide member 54 of the print wheel loading apparatus 40. Such apparatus will initially be in its unloaded position as shown in FIGS. 1 and 2. The cartridge 42 is loaded onto the guide member 54 by locating the edge guide members 66 formed on the rear cover 126 of the housing 122 with the edge sleeves 64 formed on the guide member 54. Once this location is achieved, the cartridge 42 is then slid down through the sleeves 64. When it reaches the point that the posts 120 engage the recesses 118 in the engagement finger portions 98 and 100 of the pivot control assembly 76 (see FIG. 7), further downward movement of the cartridge will cause the engagement finger portions 98 and 100 to be pivoted about the pivot rod 104. As such pivoting takes place, the pin 94 will cause the support 82 to pivot about the pin 84 until the over-center spring 88 passes across the center of the pin 86, thereby springing the support 82 and pivot arm 80 forwardly to a loaded position. In the meantime, the cartridge 42 will have been moved further downward until the stops 152 engage the pair of hinge assemblies (56–62).

In the action of pivoting the finger engagement portions 98 and 100 about the pivot rod 104, the rod 104 will ride along a cam surfce 156 (FIG. 7) of the support 82 until it disengages therefrom following completed pivotal movement. Such disengagement will allow the pivot rod 104 to move rearwardly, thereby correspondingly moving the flange portions 105 of the guide member 54 rearwardly to pivot the guide member 54 in a rearward direction about the pair of hinge assemblies (56–62). Rearward movement is facilitated under the biasing action of the spring 68 until the stop 72 (FIG. 2) engages the depending portion 74 on the support plate 44. The springs 92 and 108 cooperate with spring 88 in retaining the pivot control assembly 40 in a loaded position, as shown in FIGS. 3–6 and 8.

It should be noted that when the print wheel 26 is loaded onto the drive coupling member 146 in the manner just above described, the front cover 124 of the cartridge housing 122 is bowed outwardly due to the outward force exerted against the hub portion 130 of the print wheel 26. An opposing biasing force is thus established to insure that the locating tab 150 remains engaged with a slot 140 in the hub portion 130.

When it is desired to unload the print wheel 26 from the drive coupling member 146 (FIG. 4) and remove the cartridge 42 from the guide member 54, the pivot arm 80 is manually moved rearwardly in the direction shown by the arrow in FIG. 8. This will cause the cam surface 156 (FIG. 7) to re-engage the pivot rod 104 moving it and the flange portions 105 of the guide member 54 forwardly, thereby causing the guide member 54 to pivot forwardly about the pair of hinge assemblies (56–62). This forward movement, although arcuate, is generally parallel to the axis of rotation of the motor drive shaft 28. Eventually, the over-center springs 88, 92 and 108 will pass the center of their adjacent pins 84, 94 and 106, respectively, and thus serve to bias the pivot control assembly 76 into its unloaded position (FIG. 7).

In addition to the forward pivotal movement of the guide member 54, which will effect a release of the drive coupling member 146 (FIG. 4) from the hub portion 130 of the print wheel (FIG. 5), the pivoting action of the support 82 about the pin 84 will also result in depending flange portion 112 of the pivot arm support 82 re-engaging the pin 94 to cause the engagement member 96 to pivot about the pivot rod 104, thereby causing the engagement finger portions 98 and 100 thereof to pivot upwardly to an unloaded position (see FIG. 7). Such upward movement will cause a corresponding upward movement of the cartridge 42 through the guide member 54, thereby facilitating its removal from the guide member 54.

Although the invention has been described with respect to a presently preferred embodiment, it will be appreciated by those skilled in the art the various modifications, substitutions, etc. may be made without departing from the spirit and scope of the invention as defined in and by the following claims.

What is claimed is:

1. For use in an an impact printer having a movable carriage, a motor supported by said carriage and including a rotatable shaft, and a drive coupling member affixed to an end of said shaft, apparatus for loading a print wheel contained in a cartridge onto said drive coupling member in order for said print wheel to be rotated by said motor, said apparatus comprising:

a support member mounted to said carriage for movement therewith;

a guide member mounted to said support member for movement generally parallel to the axis of rotation of said shaft between first and second positions, said guide member being adapted when in its first position to engage and guide the movement of a printwheel cartridge along said guide member in a direction generally transverse to the axis of rotation of said shaft; and means coupled to said support member and active upon movement of a print wheel cartridge along said guide member for automatically moving said guide member from its first position to its second position to thereby load a print wheel contained in said cartridge onto said drive coupling member.

2. The apparatus of claim 1, further comprising means coupled to said support member for moving said guide member from its second position to its first position to thereby unload said print wheel from said drive coupling member.

3. The apparatus of claim 1 or claim 2, wherein said guide member is pivotally mounted to said support member for movement between said first and second positions.

* * * * *